United States Patent [19]

Liberman

[11] Patent Number: 4,841,865

[45] Date of Patent: Jun. 27, 1989

[54] SMOKE COMPOSITION AND METHOD OF MAKING SAME

[75] Inventor: Thomas Liberman, Montreal, Canada

[73] Assignee: Her Majesty the Queen in right of Canada, as represented by the Minister of National Defence, Ottawa, Canada

[21] Appl. No.: 172,157

[22] Filed: Mar. 23, 1988

Related U.S. Application Data

[63] Continuation-in-part of Ser. No. 119,343, Nov. 10, 1987, abandoned.

[30] Foreign Application Priority Data

Jun. 17, 1987 [CA] Canada ..... 539912

[51] Int. Cl.[4] ..... F42B 13/44

[52] U.S. Cl. ..... 102/334; 149/31; 149/42; 149/46; 149/87; 149/109.6

[58] Field of Search ..... 149/42, 31, 46, 109.6, 149/87; 102/334

[56] References Cited

U.S. PATENT DOCUMENTS

| | | | |
|---|---|---|---|
| 2,635,953 | 10/1947 | Silverstein | 149/31 X |
| 3,948,698 | 4/1976 | Elrick et al. | 149/19.6 |
| 4,066,415 | 1/1978 | Kasama et al. | 23/281 |
| 4,098,872 | 7/1978 | Staendeke et al. | 423/265 |
| 4,113,841 | 9/1978 | Staendeke et al. | 423/265 |
| 4,365,557 | 12/1982 | Couture et al. | 102/341 |
| 4,422,383 | 12/1983 | Couture et al. | 102/364 |
| 4,503,004 | 3/1985 | Mirabella | 102/334 X |
| 4,534,810 | 8/1985 | Knapp | 102/334 X |
| 4,624,186 | 11/1986 | Widera et al. | 102/334 X |
| 4,697,521 | 10/1987 | Espagnacq et al. | 102/334 X |

*Primary Examiner*—Peter A. Nelson

*Attorney, Agent, or Firm*—Nixon & Vanderhye

[57] ABSTRACT

A composition for producing smoke from phosphorus vapor for use in search and rescue markers and a method of producing such composition. The composition comprises a blended mixture of the following ingredients in the following weight percentage ranges:

red phosphorus—55% to 80%;

oxidizing agent (sodium nitrate or ammonium nitrate)—10% to 30%;

metal fuel—5% to 10%;

acid absorber—1% to 5%; and synthetic rubber binder—1% to 8%.

Such a composition tends to be more stable and reliable than previous compositions used for this purpose, as well as less hazardous to manufacture. In addition, it permits an increase in the proportion of red phosphorus used, with a resultant increase in burn time and/or flame and smoke emission.

31 Claims, No Drawings

SMOKE COMPOSITION AND METHOD OF MAKING SAME

CROSS-REFERENCE TO RELATED APPLICATIONS

This application is a continuation-in-part of earlier application Ser. No. 119,343 filed Nov. 10, 1987 now abandoned.

BACKGROUND OF THE INVENTION

The present invention relates to a smoke composition and method of making the same; more particularly to a red-phosporusbased composition, which may be used with a pyrotechnic tube as a marker in search and rescue operations to emit both flame and smoke.

Very often, in the course of search and rescue operations by military and civilian agencies, the need arises to distinctly mark a particular point on water. The deployed marker must be highly visible night or day so that a combination marker, emitting both flame and smoke, is necessary. The marking device, which can be dropped into water by aircraft, must float in water. It must give as large a volumne of smoke and flame for as long as possible.

At the present time, the marker most commonly used by many organizations for marine marking is one which produces a flame and smoke by burning a jet of phosphorus vapor which comes out of a small opening at the top of the marker and spontaneously inflames when it contacts air. Upon functioning, the marker emits a bright yellow flame and a large quantity of white smoke for a period of time (e.g. 15 to 18 minutes). Such marker device is considered robust, reliable and relatively compact.

The phosphorus vapor for such a marker is generated by the vaporization of red phosphorus (hereinafter RP) from a pyrotechnic composition which has been pressed as a candle inside a pyrotechnic tube. An example of such a composition is:

| INGREDIENTS | TYPICAL FORMULATION |
|---|---|
| red phosphorus (RP) | 51.5% |
| manganese dioxide, $MnO_2$ | 35.1% |
| magnesium powder, Mg | 7.2% |
| zinc oxide, ZnO | 3.1% |
| linseed oil (double boiled) | 3.1% |

The main reaction in such a conventional marker is between manganese dioxide and magnesium. This reaction produces the heat required to vaporize the RP. The linseed oil functions both as a lubricant during pressing of the smoke candle and as a binder, holding the ingredients together after pressing the composition. The zinc oxide is added as a stabilizer, mainly to neutralize any acids that are formed as the composition ages.

Manufacture of conventional marker candles is accomplished according to well-defined and proven techniques. After all of the ingredients have been intimately mixed, the composition is pressed into cylindrical, laminated paper tubes to form the candles for the markers. The pressing is done at 9900 psi in 3 increments with a dwell time of 3–10 seconds for each increment. The pressing operation must be performed no later than 8 hours after mixing the composition, otherwise the linseed oil will dry and become useless as a binder.

Nominal specifications for such markers call for 744±40 g of composition pressed into a laminated paper tube 29.9 cm long, with an internal diameter of 4.4 cm. Typical composition length is 25–26 cm, which leaves several centimeters for a starter composition. The linear burn rate for such a marker candle is approximately 1.3 cm per minute.

Although such a composition functions quite reliably as a marine marker, several problems and shortcomings exist with its production and performance. The chief problem is the fire hazard that exists during production of the composition. RP is very prone to ignition by the friction present during mixing. The risk of ignition is further augmented by the presence of oxidizer (manganese dioxide), so that fires are common during production of this compositon. In addition, the pressed compositon, once fully dried, is quite brittle and tends to crack. The hard, jagged surfaces at the crack can ignite very easily if allowed to rub against each other.

Performance is hampered by the low loading of RP in the composition, caused by the use of a low efficiency oxidizer, manganese dioxide ($MnO_2$). Because of its low active-oxygen-content, the oxidizer must account for over one-third of the weight of the composition—room that could otherwise be filled with RP. Magnesium metal is the fuel in the composition, which, upon reacting with manganese dioxide provides the heat necessary to vaporize the RP. Although, magnesium is an excellent high-energy fuel, it is prone to corrosion if there is any moisture present. It reacts with the small amounts of water always present in the composition to give hydrogen, as well as promoting the formation of phosphine ($PH_3$) gas from the RP. In addition, corroded magnesium is useless as a fuel.

Several processing and performance problems arise from the use of linseed oil as the binder. Its main disadvantage, from a processing standpoint, is the time limit it imposes between the mixing and pressing operations. The linseed oil begins to dry as soon as it is incorporated in the composition and exposed to air, with the result that the composition must be pressed within 8 hours, the time the oil takes to dry.

Performance is affected by the relatively poor binding properties of the oil. As mentioned previously, the pressed composition has poor mechanical properties and is easily fractured by stress, such as that caused by the marker impacting in the water or during rough handling. Such fractures not only increase the risk of spontaneous ignitions but may result in reaction- propagation-failure during regular functioning of the marker.

Finally, there are problems with the use of zinc oxide as a stabilizer, including the poor acid-absorbing capability of that compound and the fact that it is somewhat toxic.

It is an objective of the present invention to provide an improved composition to be used in producing marine markers (or indeed, producing markers for other purposes) which is not the subject to the drawbacks of the conventional composition, as previously described. Itis a further objective of the present invention to provide a composition which has an increased smoke-producing efficiency.

SUMMARY OF THE INVENTION

In accordance with the present invention there is provided a composition for producing smoke from phosphorus vapor. The composition comprises a blended mixture of the following ingredients in the following weight percentage ranges: red phosphorus—55% to 80%, oxidizing agent (sodium nitrate or ammonium nitrate)—10% to 30%, metal fuel—5% to 10%, acid absorber—1% to 5%, and a synthetic rubber binder—1% to 8%. Preferably included is titanium alcoholate (to generate titanium hydroxide on contact with moisture)—1% to 4%.

A preferred formulation of the composition is one in which the ingredients are present in the following weight percentages: red phosphorus—71%, sodium nitrate—15%, aluminum flake—8%, calcium carbonate—1%, titanium iso-propoxide—1%, and polybutadiene binder of a high cis-1,4 configuration—4%.

The invention further provides a method of making a composition for producing smoke from phosphorus vapor, the method comprising mixing sufficient red phosphorus to give a weight percent in the final composition in the range of 55% to 80% with sufficient metal fuel to give a weight percent in the final composition in the range of 5% to 10% and sufficient acid absorber to give a weight percent in the final composition in the range of 1% to 5%. Sufficient synthetic rubber binder dissolved in a suitable organic solvent such as toluene, is then added, to give the synthetic rubber binder a weight percent in the final composition in the range of 1% to 8%. Preferably, sufficient titanium alcoholate (which will generate titanium hydroxide on contact with moisture) is then added to give a weight percent in the final composition in the range of 1% to 4%. The preceding ingredients are then mixed to form a mixture of pasty consistency. Sufficient oxidizing agent (sodium nitrate or ammonium nitrate) is then added to the mixture to give a weight percent in the final composition in the range of 10% to 30%. The mixture is then stirred to blend the oxiding agent evenly into the mixture and form a homogeneous paste. The mixture in then dried, to remove most or all of the solvent. The composition thereby produced may be then further processed into marker candles or stored for such processing subsequently.

DETAILED DESCRIPTION OF THE INVENTION

It will be understood that the basic method by which the composition in accordance with the present invention functions (i.e. the production of phosphorus vapor by vaporization of RP, and its subsequent combustion to give flame and smoke) is the same as with conventional compositions as described previously herein. Thus, the RP is still the principal ingredient of the composition. However, the amount of RP loading is significantly increased, i.e. by about 15% to 20% over that included in the earlier exemplified prior art composition.

In general, the purity specifications for the ingredients making up the composition according to the present invention are not very stringent, but it is preferable that heavy metals such as lead and copper be absent. These metals tend to catalyze the formation of phosphine ($PH_3$) from the RP. Typical specifications for ingredients presently used in the examples are as follows. The RP conforms to the same specifications as in the presently used composition, namely military specification MIL-P-2111, Class 2. Under this specification, the RP may contain only traces of heavy metals and 98% is to pass through a 100 mesh sieve.

In order to accommodate the additional RP a more efficient oxidizing agent is required, i.e. one which occupies less space and provides more available oxygen per unit weight than the previously employed $MnO_2$ and provides a stronger exothermic reaction with the metal fuel to provide the additional heat necessary to vaporize substantially all of the RP.

The oxidizing agent employed by applicant is selected from sodium nitrate and ammonium nitrate. Sodium nitrate is preferred because of its higher efficiency on a weight basis (i.e. more available oxygen). Preferably, 12% to 15% by weight of sodium nitrate is included in the composition. The sodium nitrate employed is a reagent grade purchased from Anachemia Chemical of Montreal, Canada (any equivalent purity grade may be substituted). Before use, it is ground in a suitable mill and passed through a 40 mesh sieve.

The metal fuel is typically magnesium powder or aluminium flake. Aluminium flake increases the stability and moisture resistance of the composition since aluminium is more resistant to corrosion than magnesium. In addition, aluminium does not tend to promote formation of phosphine ($PH_3$) gas in the presence of moisture and RP as magnesium does. When using aluminium, the particle size and shape is most important. It has been found that many types of Al will not react as fuels in the composition in spite of very small particle size. Therefore, it is important that the Al is in a flake form.

Commercial aluminium flakes form tiny flat plates of irregular shape and large surface area (i.e. large specific surface). They differ in particle size and surface conditions: typically their thicknesses range between 0.1 and 0.3 μm and their nominal diameters between 0.3 and 150 μm. The particle size of a suitable commercial aluminium flake material (Reynolds 40XD) is reported as 10 μm, i.e. the actual average particle size (i.e. nominal diameter). Scanning Electron Microphotographic (SEM) examination shows a sample of this material to contain particles as small as 1.5 μm and as large as 25 μm. Alcoa extra-fine lining powder (No. 422) is given, in the literature, as an equivalent material composition. The so-called "Pyro" aluminium has also been employed. It consists of very fine flake powder produced in varying shades of dark grey. Although it has a nominal mesh size of 200 ("BLUEHEAD") or 400 ("BLACKHEAD"), it is reported to contain particles as fine as 2 μm and said to incorporate a small percentage of carbon that promotes ignitability.

An acid absorber is also included in the composition. Zinc oxide which also acts as a stabilizer may be employed. However, better acid absorbers are available such as calcium carbonate. Other carbonates, e.g. sodium carbonate may also be employed. The preferred calcium carbonate used should be a chemcially pure (CP) quality of precipitated chalk. It should pass a 40 mesh screen before use.

Preferably, a substance which generates titanium hydroxide is included in the composition as a stabilizer for the red phosphorous. For example, titanium isopropoxide is included. The titanium iso-propoxide may be of any suitable brand of reagent quality. Other titanium (IV) alcoholates, such as titanium tert-butoxide, may be used as substitutes, since they also yield $Ti(OH)_4$ upon hydrolysis. A small quantity of the corresponding alcohol may be added to the titanium alcoholates (volume equal to the volume of the alcoholate) to enhance the storage stability of these compounds).

Finally, a synthetic rubber binder is included in the composition. This type of binder permits an indefinite time between mixing and pressing operations. There is no longer an hour time limit between mixing and pressing as exists when linseed oil is used as the binder. Moreover, the composition is indefinitely stable after drying and may be stored for long periods of time prior to pressing. A listing of suitable synthetic rubber binders is included in Table 1 below.

TABLE 1

| Trade Name | Producer | Type |
|---|---|---|
| NORDEL | Du Pont Co. | Ethylene-propylene-diene terpolymer (EPDM) |
| NEOPRENE | Du Pont Co. | Polychloroprene |
| HYTREL | Du Pont Co. | Polyester thermoplastic elastomer |
| HYPALON | Du Pont Co. | Chlorosulfonated Polyethylene |
| TAKTENE | Polysar Ltd. | Polybutadiene |

The polybutadiene-class of binder is preferred. Within this class, a preferred material is Taktene 1202, a trade mark of Polysar Canada Limited. The Taktene rubbers are polybutadienes of a high cis-1,4 configuration. The Taktene 1202 is a high purity, essentially gel-free, grade. It dissolves easily in toluene and contains no additives or extenders. Its chemical configuration gives it good properties even at low temperatures. Also, it was found that Taktene 1202 had superior binding and burning properties.

In order to control the burn rate of the composition and, at the same time, make sure enough heat is produced to vaporize most of the RP out from the composition, the amounts of oxidizer and fuel are adjusted. For example, in the case where the oxidizer/fuel pair is sodium nitrate/aluminum flake, the mass ratio of oxidizer to fuel may be kept constant at, for example, about 1.9 (stoichiometric, to obtain $Al_2O_3$ and $N_2$ as the products). Other oxidizer/fuel pairs include ammonium nitrate/magnesium powder and ammonium nitrate/aluminum flake. It will be noted from the examples which follow that the oxidizer/fuel ratio is not always equal to the actual stoichiometric ratio, i.e. the stoichiometric ratio for the various oxidizer/fuel pairs should be: $NH_4NO_3/Mg=3.33:1$, $NH_4NO_3/Al=4.4:1$ and $NaNO_3/Mg=1.89:1$. Accordingly, throughout all the different possible compositions within the scope of the present invention, their total percentage may be increased or decreased to obtain the desired effect.

EXAMPLE

The present description is intended to be an example of the general method for the preparation of a composition according to the invention, with an approximate batch size of 1 kg.

It has been found that the following formulation having approximate proportions of ingredients (percent by weight) as indicated, when incorporated into a marine location marker candle, gives the required linear burn rate of 1.3 centimeters per minute and evaporation of virtually 100% of the RP in the candle:

71% RP
15% $NaNO_3$ (less than 40 mesh, Anachemia Reagent)
8% Al flake 40XD approx. 10 μm flake (Reynolds Aluminum Co.)
1% $CaCO_3$ CP 40 mesh or finer
1% $Ti(iso\text{-}OC_3H_7)_4$ (Aldrich Chemical Company, Milwaukee, Wis.)
4% Taktene 1202 (trade mark of Polysar, Canada)

First, a 10% (by weight) solution of Taktene 1202 is prepared by leaving the required quantity of small polymer pieces in toluene for several days with occasional stirring. A clear, viscous solution results. The solution is left aside; it will be used later.

The appropriate quantity of RP is weighed in a suitable vessel. The Al-flake powder is weighed out and added to the RP. It is important that the Al used is of a flake type, as specified in the example, since the spheroidal kind of Al will not react under the conditions found in the candle. The $CaCO_3$ may now be weighed out and added; its grade and purity is not critical. The $NaNO_3$ oxidizer is purposely left out until last, after the mixture is wet with the toluene-Taktene solution. This is a safety precaution and insures that RP-oxidizer is never mixed when dry.

The ingredients now form a heterogenous body of fluffy powders, easily dispersed in air, lying beside the Taktene solution. It is at this point that the $Ti(iso\text{-}OC_3H_7)_4$ is most favourably added, directly to the liquid phase of Taktene solution. Alternatively, the titanium compound may be added during the next mixing stage. At this point in the processing, $NaNO_3$, the oxidizer, is still missing from the mixture. This means the mixture can be made wet with the Taktene solution before any oxidizer is added. Assuming the $Ti(iso\text{-}OC_3H_7)_4$ has been already added, all the ingredients except $NaNO_3$, are now in the mixture and pre-mixing can begin. This allows the RP to become thoroughly wet before any oxidizer is added.

All mixing is done in a Hobart (trade mark) "bread-dough" planetary mixer. During pre-mixing, the machine is set at a slow speed, (approx. 120 rpm) to keep the RP and Al dusting to a minimum. If the mixture proves too viscous, extra pure toluene may be added to the batch. The amount is not too important since all of the toluene is evaporated during the drying stage. Alternatively, a more dilute rubber solution may be prepared in the first place. After the first 2–3 minutes, when the powders and polymer solution have begun to blend, the speed may be increased to a medium setting (approx. 240 rpm). This pre-mixing is usually allowed to continue for about 15 minutes after which the mixture has a pasty consistency and is ready for the final addition of $NaNO_3$ oxidizer. Toluene may be added at any point during the mixing procedures to decrease the viscosity. The measured amount of $NaNO_3$, which has passed a 40 mesh sieve, is now added to the pre-mix. Once again the Hobart blades are lowered and the mixture is stirred, starting at a slow speed and then changing to the high-speed setting (approx. 480 rpm). Mixing is continued for approximately 30 minutes at high speed to ensure the break-up of any RP lumps. At the termination of the mixing stage, the mixture should be a homogeneous paste, almost pourable, and silvery in colour due to the flake Al content. This paste is emptied out onto Pyrex (trade mark) glass trays and dried in circulating-air ovens. A typical drying temperature is 60° C.–70° C. Drying should be complete within about 12 hours. The composition may be considered completely dry when the smell of toluene is no longer present. A slight residue of toluene is not considered detrimental to further processing. At this point, the finished, but unpressed, composition takes the form of porous, rubbery lumps with a silver-grey colour. Although not unduly sensitive to shock, friction, or static electricity, it must be handled with extreme caution. This form of the composition may be put into containers for indefinite storage, or it may be taken directly to the next stage for pressing into pyrotechnic candles.

The composition as prepared has been subjected to a pressing operation to produce experimental pyrotechnic RP candles on a small scale. To do this, a split-ring mold is used to hold the laminated-paper pyrotechnic tube and the composition is manually loaded into the tube. In the present method, the lumps of composition are pressed at approx. 10,000 psi in 6 increments of $4\times150$ g$+2\times50$ g. This yields a candle with 700 g of the RP composition and typical length of 23.5 cm$\times$4.3 cm diameter; corresponding to a density of 2.05 g/cm$^3$. This is 80% of the calculated theoretical density of 2.3 g/cm$^3$ for the RP mixture. The pressed composition has the consistency of hard rubber along with good mechanical properties. It has a metallic shine due to the flake Al content. The pressed composition, which may be stored indefinitely, is now ready for incorporation into the markers.

Additional examples of compositions according to the invention appear in Tables 2–4 as follows.

NOTES

1. All reported compositions were prepared according to the procedure described in the patent application. Toluene was the solvent used in all cases with the exception of C27, where HYTREL necessitated the use of methylene chloride.
2. The linear burning rates reported are observed when the composition is incorporated into marine location marker candles. All compositions given here showed evaporation of virtually 100% of the red phosphorus in the candle.
3. The magnesium in all of the compositions was of Type 1, Grade A, 95% of which would go through a 125 μm sieve (120 Mesh) and not more than 5% to go through a 75 μm sieve (200 Mesh).

TABLE 2

Compositions containing $NH_4NO_3$ and Mg

| IDENTIFICATION NO. | COMPOSITION | BURN RATE (cm/min) | COMMENTS |
|---|---|---|---|
| C18 | 68% P (red)<br>20% $NH_4NO_3$<br>5% Mg<br>3% $CaCO_3$<br>4% NORDEL 2522 | 1.3 | NORDEL binder. |
| C20 | 68% P (red)<br>20% $NH_4NO_3$<br>5% Mg<br>3% $CaCO_3$<br>4% NEOPRENE | 2.8 | Similar to C18 but NEOPRENE is used as binder. |
| C26 | 68% P (red)<br>20% $NH_4NO_3$<br>5% Mg<br>3% $CaCO_3$<br>4% NORDEL 1320 | 1.8 | Similar to C18 but a softer grade of NORDEL is used as binder. |
| C27 | 71% P (red)<br>17% $NH_4NO_3$<br>5% Mg<br>3% $CaCO_3$<br>4% HYTREL | 1.9 | HYTREL binder. Methylene Chloride is used to dissolve dissolve HYTREL. |
| C37 | 66% P (red)<br>20% $NH_4NO_3$<br>5% Mg<br>3% $CaCO_3$<br>6% HYPALON | 1.1 | HYPALON binder. |

TABLE 3

Compositions containing $NH_4NO_3$ and Al

| IDENTIFICATION NO. | COMPOSITION | BURN RATE (cm/min) | COMMENTS |
|---|---|---|---|
| C36 | 67% P (red)<br>21% $NH_4NO_3$<br>5% Al (40XD)<br>3% $CaCO_3$<br>4% NORDEL 2522 | 1.5 | NORDEL binder. |
| C39 | 67% P (red)<br>21% $NH_4NO_3$<br>5% Al (40XD)<br>3% $CaCO_3$<br>4% HYPALON | 2.2 | Similar to C36 but HYPALON binder is used. |
| C40 | 58% P (red)<br>27% $NH_4NO_3$<br>6% Al (40XD)<br>3% $CaCO_3$<br>6% NORDEL 2522 | 0.96 | Increased binder content. |
| C41 | 64% P (red)<br>21% $NH_4NO_3$<br>6% Al (40XD)<br>3% $CaCO_3$<br>6% HYPALON | 2.4 | Increased binder content. |

TABLE 4

Compositions containing $NaNO_3$ and Al

| IDENTIFICATION NO. | COMPOSITION | BURN RATE (cm/min) | COMMENTS |
|---|---|---|---|
| C50 | 76% P (red)<br>12% $NaNO_3$<br>6% Al (40XD)<br>2% TiIP<br>1% $CaCO_3$<br>4% HYPALON | 1.7 | HYPALON binder. TiIP stands for titanium iso-propoxide. |
| C55 | 71% P (red)<br>15% $NaNO_3$<br>8% Al; (40XD)<br>1% TiIP<br>1% $CaCO_3$<br>4% TAKTENE 1202 | 1.3 | TAKTENE binder. Example given in current patent application. |
| C60 | 71% P (red)<br>15% $NaNO_3$<br>8% Al (BLACKHEAD)<br>1% TiIP<br>1% $CaCO_3$<br>4% TAKTENE 1202 | 0.86 | Similar to C55 but fuelled by "Pyro" aluminium of 400 Mesh (nominal size). |
| C61 | 71% P (red)<br>15% $NaNO_3$<br>8% Al (BLUEHEAD)<br>1% TiIP<br>1% $CaCO_3$<br>4% TAKTENE 1202 | 0.94 | Similar to C55 but fuelled by "Pyro" aluminium of 200 Mesh (nominal size). |

It will be understood, when comparing the composition and process of the present invention with the conventional composition and process for making it, that the mechanical manipulation of dry RP, or mixtures containing it, is frought with fire risk. Accidental ignitions during the processing of the conventional RP compositions as described previously, occurred frequently. For this reason processing the RP compositions in accordance with the present invention in a slurry with solvent is a significant advantage of the present invention. Adding the binder dissolved in a solvent is an effective method for incorporating it in the composition and at the same time removes the hazards of dry-processing RP mixtures. For extra safety, the oxidizer is the last ingredient to be added. By that time the composition has been pre-mixed and is thoroughly wetted with the solvent. Finally, the presence of a visco-elastic binder like Taktene tends to decrease sensitivity to initiation by impact of the pressed product. Moreover, the compositions of the present invention are much less brittle and are quite fracture resistant, giving improved safety during vibration.

If, as combustion-weight-loss calculations indicate, there is enough heat generated to vaporize substantially all of the RP, because of the increased RP loading there will be a corresponding increase in both flame and smoke emission for the new compositions over the conventional one. Experimental observations confirm this; markers burning the new composition have significantly larger flames and produce larger amounts of smoke than markers burning similar quantities of the conventional composition. The new composition, in addition, burns for somewhat longer than the conventional one.

What is claimed is:

1. A composition for producing smoke from phosphorus vapor, the composition comprising a blended mixture of the following ingredients in the following weight percentage ranges:

red phosphorus—55% to 80%;
oxidizing agent selected from the group consisting of sodium nitrate and ammonium nitrate—10% to 30%;
metal fuel—5% to 10%;
acid absorber—1% to 5%; and
synthetic rubber binder—1% to 8%.

2. A composition according to claim 1, additionally comprising a titanium alcoholate (to generate titanium hydroxide on contact with moisture) selected from the group consisting of titanium iso-propoxide and titanium tert-butoxide.

3. A composition according to claim 2, wherein the metal fuel is selected from the group consisting of magnesium powder and aluminium flake.

4. A composition according to claim 3, wherein the metal fuel is aluminium flake.

5. A composition according to claim 4, wherein the aluminium flake is of an average particle size of about 10 μm.

6. A composition acording to claim 5, wherein the oxidizing agent is sodium nitrate.

7. A composition according to claim 6, wherein the titanium alcoholate is titanium iso-propoxide.

8. A composition according to claim 7, wherein the synthetic resin binder is a polybutadiene binder.

9. A composition according to claim 8, wherein the acid absorber is calcium carbonate.

10. A composition according to claim 9, wherein the weight percentage of sodium nitrate in the fuel composition is 12% to 15%.

11. A composition according to claim 10, wherein the polybutadiene binder is a polybutadiene of high cis-1,4 configuration.

12. A composition according to claim 9, wherein the ingredients are present in the approximate weight percentages:

red phosphorus—71%
sodium nitrate—15%
aluminium flake—8%
calcium carbonate—1%
titanium iso-propoxide—1%
polybutadiene of high cis-1,4 configuration—4%.

13. A method of making a composition for producing smoke from phosphorus vapor, the method comprising the steps of:

(a) mixing sufficient red phosphorus to give a weight percent in the final composition in the range of 55% to 80% with sufficient metal fuel to give a weight percent in the final composition in the range of 5% to 10% and sufficient acid absorber to provide a weight percent in the final composition in the range of 1% to 5%;
(b) dissolving the synthetic rubber binder in a suitable organic solvent to provide a binder solution, wherein the weight percent of the binder in the final composition is in the range of 1% to 8%, and adding the binder solution to the mixture resulting from step (a);
(c) mixing the ingredients of the preceding steps to form a mixture of pasty consistency;
(d) adding to the mixture sufficient oxidizing agent selected from sodium nitrate and ammonium nitrate to give a weight percent in the final composition in the range of 10% to 30% and stirring the mixture to blend the oxidizing agent evenly into the mixture and form a homogeneous paste; and
(e) drying the mixture to remove substantially all of the solvent.

14. A method according to claim 13, which further comprises before step (c) adding sufficient titanium alcoholate (which will generate titanium hydroxide on contact with moisture) to give a weight percent in the final composition in the range of 1% to 4%.

15. A method according to claim 14, wherein the titanium alcoholate is added to the binder solution before adding the binder solution to the red phosphorus, metal fuel and acid absorber mixture resulting from step (a).

16. A method according to claim 15, wherein the metal fuel is selected from the group consisting of magnesium powder and aluminium flake.

17. A method according to claim 16, wherein the metal fuel is aluminium flake.

18. A method according to claim 17, wherein the synthetic rubber binder is a polybutadiene binder.

19. A method according to claim 18, wherein the oxidizing agent is sodium nitrate.

20. A method according to claim 19, wherein the acid absorber is calcium carbonate.

21. A method according to claim 20, wherein the weight percentage of sodium nitrate in the final composition is 12% to 15%.

22. A method according to claim 21, wherein the polybutadiene binder is a polybutadiene of a high cis-1,4 configuration.

23. A method according to claim 22, wherein the titanium alcoholate is selected from the group consisting of titanium iso-propoxide and titanium tert-butoxide.

24. A method according to claim 23, wherein the titanium alcoholate is titanium iso-propoxide.

25. A method according to claim 24, wherein the aluminium flake is of an average particle size of about 10 μm.

26. A method according to claim 19, wherein step (e) drying is effected at 60°–70° C.

27. A method according to claim 26, wherein the dried mixture is pressed into a pyrotechnic tube.

28. A method according to claim 26, wherein the dried mixture is pressed into the pyrotechnic tube at a pressure of about 10,000 psi.

29. A composition according to claim 12, wherein the red phosphorus used contains no more than traces of heavy metals and 90% thereof will pass through a 100 mesh sieve, the sodium nitrate is reagent grade and, before use, ground in a suitable mill and passed through a 40 mesh sieve, the aluminum flake is of an average particle size of about 10 μm, the calcium carbonate is 40 mesh or finer and a chemically pure quality of precipitated chalk.

30. A pyrotechnic marker candle comprising a composition according to claim 9, pressed into a pyrotechnic tube.

31. A pyrotechnic marker candle according to claim 30, further comprising a conventional starter composition pressed into the tube.

* * * * *